US008869954B2

(12) United States Patent
Marlow et al.

(10) Patent No.: US 8,869,954 B2
(45) Date of Patent: Oct. 28, 2014

(54) LUBRICATING INSERT FOR RAILROAD BRAKE HEAD ASSEMBLY

(75) Inventors: Jonathon Marlow, Hobart, IN (US); Peter Gregar, Chesterton, IN (US)

(73) Assignee: Standard Car Truck Company, Park Ridge, IL (US)

( * ) Notice: Subject to any disclaimer, the term of this patent is extended or adjusted under 35 U.S.C. 154(b) by 276 days.

(21) Appl. No.: 13/087,559

(22) Filed: Apr. 15, 2011

(65) Prior Publication Data

US 2012/0261218 A1 Oct. 18, 2012

(51) Int. Cl.
*B61H 13/36* (2006.01)

(52) U.S. Cl.
CPC ..... *B61H 13/36* (2013.01)
USPC ..... 188/233.3; 188/213; 188/52

(58) Field of Classification Search
CPC ..... B61H 13/36; F16C 29/02
USPC ..... 188/205 R, 207, 209, 212, 213, 219.1, 188/233.3, 52; 384/13, 26, 42
See application file for complete search history.

(56) References Cited

U.S. PATENT DOCUMENTS

| | | | | |
|---|---|---|---|---|
| 2,408,015 | A * | 9/1946 | Busse | 188/212 |
| 3,092,215 | A * | 6/1963 | Haydu | 188/219.1 |
| 3,589,529 | A | 6/1971 | Altherr | |
| 3,599,574 | A | 8/1971 | Robertson | |
| 3,712,691 | A | 1/1973 | Cope | |
| 3,748,001 | A | 7/1973 | Neumann et al. | |
| 3,759,400 | A | 9/1973 | Cope | |
| 3,762,338 | A | 10/1973 | Dwyer | |
| 3,802,353 | A | 4/1974 | Korpics | |
| 3,832,954 | A | 9/1974 | Amwake | |
| 3,834,774 | A | 9/1974 | Fiegl | |
| 4,084,514 | A | 4/1978 | Bullock | |
| 4,192,240 | A | 3/1980 | Korpics | |
| 4,244,298 | A | 1/1981 | Hawthorne et al. | |
| 4,463,835 | A | 8/1984 | Murphy et al. | |
| 4,463,836 | A * | 8/1984 | Murphy et al. | 188/52 |
| 4,480,721 | A | 11/1984 | Murphy | |
| 4,739,889 | A | 4/1988 | Bomgardner | |
| 4,741,085 | A | 5/1988 | Bomgardner | |
| 4,784,068 | A | 11/1988 | Burke | |

(Continued)

OTHER PUBLICATIONS

International Search Report and Written Opinion for International Application No. PCT/US2012/033008 dated Sep. 24, 2012.

(Continued)

*Primary Examiner* — Bradley King
*Assistant Examiner* — Nicholas J Lane
(74) *Attorney, Agent, or Firm* — Neal, Gerber & Eisenberg LLP

(57) ABSTRACT

A lubricating arrangement for an end guide of a railcar truck mounted brake rigging includes at least one elongated groove provided in the at least one surface of the end guide in open communication therewith, the elongated groove having a length thereof disposed generally transverse to a direction of the sliding reciprocal movement of the end guide. A lubricating member is secured within the at least one elongated groove, the lubricating member has a thickness portion thereof protruding, a predetermined height at initial installation, above the at least one surface of the end guide. The predetermined height of the protruding thickness portion is reduced during the reciprocal movement of the end guide within the channel or pocket so that material removed from the predetermined height during the reciprocal movement substantially resurfaces the at least one surface of the end guide.

19 Claims, 3 Drawing Sheets

(56) References Cited

U.S. PATENT DOCUMENTS

| | | | |
|---|---|---|---|
| 4,795,007 | A | 1/1989 | Murphy et al. |
| 4,913,062 | A | 4/1990 | Burke |
| 4,917,021 | A | 4/1990 | Murphy |
| 4,953,471 | A | 9/1990 | Wronkiewicz et al. |
| 5,086,707 | A | 2/1992 | Spencer et al. |
| 5,158,694 | A | 10/1992 | Waynick |
| 5,165,714 | A | 11/1992 | Kaim |
| 5,213,697 | A | 5/1993 | Vinci et al. |
| 5,239,933 | A | 8/1993 | Murphy et al. |
| 5,305,694 | A | 4/1994 | Wronkiewicz et al. |
| 5,305,899 | A | 4/1994 | Kaufhold |
| 5,386,783 | A | 2/1995 | Rhen et al. |
| 5,404,826 | A | 4/1995 | Rudibaugh et al. |
| 5,415,108 | A | 5/1995 | Murphy et al. |
| 5,452,665 | A | 9/1995 | Wronkiewicz et al. |
| 5,511,489 | A | 4/1996 | Bullock |
| 5,555,818 | A | 9/1996 | Bullock |
| 5,562,045 | A | 10/1996 | Rudibaugh et al. |
| 5,579,697 | A | 12/1996 | Burke |
| 5,598,936 | A | 2/1997 | Murphy |
| 5,601,031 | A | 2/1997 | Carlson |
| 5,669,745 | A | 9/1997 | Anderson |
| 5,682,964 | A | 11/1997 | Murphy |
| 5,687,650 | A | 11/1997 | Murphy |
| 5,694,859 | A | 12/1997 | Burke et al. |
| 5,701,825 | A | 12/1997 | Peach |
| 5,749,301 | A | 5/1998 | Wronkiewicz et al. |
| 5,791,258 | A | 8/1998 | Hawthorne et al. |
| 5,799,582 | A | 9/1998 | Rudibaugh et al. |
| 5,868,384 | A | 2/1999 | Anderson |
| 5,875,721 | A | 3/1999 | Wright et al. |
| 5,908,001 | A | 6/1999 | Burke et al. |
| 5,940,889 | A | 8/1999 | Shirai |
| 5,975,818 | A | 11/1999 | Burke et al. |
| 6,050,199 | A | 4/2000 | Anderson et al. |
| 6,068,146 | A | 5/2000 | Trent et al. |
| 6,092,470 | A | 7/2000 | O'Donnell |
| 6,136,240 | A | 10/2000 | Burke et al. |
| 6,141,853 | A | 11/2000 | O'Donnell |
| 6,142,082 | A | 11/2000 | Burke et al. |
| 6,148,734 | A | 11/2000 | Gwinn |
| 6,199,708 | B1 | 3/2001 | Monaco |
| 6,276,283 | B1 | 8/2001 | Weber |
| 6,341,422 | B1 | 1/2002 | O'Donnell |
| 6,367,590 | B1 | 4/2002 | Burke |
| 6,374,749 | B1 | 4/2002 | Duncan et al. |
| 6,425,334 | B1 | 7/2002 | Wronkiewicz et al. |
| 6,446,820 | B1 | 9/2002 | Barker et al. |
| 6,471,211 | B1 | 10/2002 | Garnett et al. |
| 6,553,917 | B1 | 4/2003 | Burke et al. |
| 6,561,740 | B1 | 5/2003 | Burke et al. |
| 6,609,830 | B2 | 8/2003 | Bank et al. |
| 6,644,214 | B1 | 11/2003 | Schorr |
| 6,688,236 | B2 | 2/2004 | Taillon |
| 6,691,625 | B2 | 2/2004 | Duncan |
| 6,701,850 | B2 | 3/2004 | McCabe et al. |
| 6,708,624 | B2 | 3/2004 | Faryniak et al. |
| 6,786,160 | B1 | 9/2004 | Peach et al. |
| 6,792,871 | B2 | 9/2004 | O'Donnell |
| 6,792,874 | B1 | 9/2004 | Anderson et al. |
| 6,805,523 | B2 | 10/2004 | Burke et al. |
| D497,838 | S | 11/2004 | Anderson |
| 6,862,999 | B2 | 3/2005 | O'Donnell et al. |
| 6,877,623 | B2 | 4/2005 | Salis |
| 6,957,611 | B2 | 10/2005 | O'Donnell et al. |
| 6,964,233 | B2 | 11/2005 | Peach et al. |
| 6,971,319 | B2 | 12/2005 | Bowden |
| 7,083,165 | B2 | 8/2006 | Palinkas |
| 7,121,212 | B2 | 10/2006 | Schorr |
| 7,128,312 | B2 | 10/2006 | Salis |
| 7,244,695 | B2 | 7/2007 | Eadie |
| 7,275,487 | B2 | 10/2007 | O'Donnell |
| RE39,998 | E | 1/2008 | Francois |
| 7,328,659 | B2 | 2/2008 | Forbes |
| 7,338,034 | B2 | 3/2008 | Aspengren et al. |
| 7,389,731 | B2 | 6/2008 | Rudibaugh et al. |
| 7,469,641 | B2 | 12/2008 | Berg et al. |
| 7,513,199 | B2 | 4/2009 | Van Auken |
| 7,513,295 | B2 | 4/2009 | Poncin et al. |
| 7,527,003 | B1 | 5/2009 | Schorr et al. |
| 7,540,387 | B2 | 6/2009 | Sommerfeld |
| 7,546,807 | B2 | 6/2009 | Johnstone et al. |
| 7,549,379 | B2 | 6/2009 | Monaco et al. |
| 7,568,584 | B2 | 8/2009 | Brough et al. |
| 7,802,524 | B1 | 9/2010 | Gregar |
| 7,837,046 | B2 | 11/2010 | Brewster |
| 7,845,288 | B2 | 12/2010 | Forbes et al. |
| 7,935,431 | B2 | 5/2011 | Poncin et al. |
| 8,147,980 | B2 | 4/2012 | Bhide |
| 2002/0073880 | A1 | 6/2002 | Wronkiewicz et al. |
| 2003/0106456 | A1 | 6/2003 | Faryniak et al. |
| 2005/0087092 | A1 | 4/2005 | McKisic et al. |
| 2008/0011700 | A1 | 1/2008 | Brough et al. |
| 2008/0035012 | A1 | 2/2008 | Monaco et al. |

OTHER PUBLICATIONS

Non-Final Office Action dated Mar. 4, 2014, for U.S. Appl. No. 13/568,745.

* cited by examiner

LUBRICATING INSERT FOR RAILROAD BRAKE HEAD ASSEMBLY

FIELD OF THE INVENTION

The present invention relates, in general, to truck mounted railcar brake riggings and, more particularly, this invention relates to a lubricating insert for an end guide of such railcar brake riggings.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND OF THE INVENTION

As is generally well known, truck mounted brake rigging for a railcar is supported by rigid rectangular guide members that engage channels or side pockets in the railcar truck side frame for sliding reciprocal movement therewithin. The end guide members, also commonly called end feet, end lugs or guide lugs, are either secured to ends of the brake beams or the brake head assembly mounted on the end of the brake beam. As the brake system is applied and released, the end members slide up and down the side frame pockets to guide brake shoes into proper engagement with the wheel threads. It is further generally known that friction during such sliding movement between steel end members and steel side frame channels or pockets prevents uniform application of all brake shoes of the brake rigging and results in uneven wear of the brake shoes.

Prior to conception and development of the instant invention, efforts have been made to reduce friction and improve train handling during brake application.

U.S. Pat. No. 5,682,964 issued to Murphy teaches a brake beam wear liner being a generally U-shape and configured for insertion into the side frame channel or pocket. The wear liner is molded from a polymer based material. However, it has been found that such wear liners become damaged over time resulting in higher than desirable replacement and maintenance costs.

U.S. Pat. No. 4,480,721 also issued to Murphy teaches a snap-on slide bearing that essentially surrounds at least top and bottom surfaces of the end member and having a projection on a bottom surface of one wall thereof that is sized for snap fit into a recess in the upper surface of the end member. The slide bearing is manufactured from ultra high molecular weight polyethylene material. Such sliding bearing may be used in combination with the wear liner of U.S. Pat. No. 5,682,964.

Teachings of U.S. Pat. Nos. 5,682,964 and 4,480,721 are incorporated hereby by reference thereto.

However, there is a further need for an arrangement to reduce friction between the end member and the side frame channel or pocket, so as to improve operating life of the wear liner, promulgate even brake shoe wear and improve train handling during brake application.

SUMMARY OF THE INVENTION

The invention provides means for lubricating at least one surface of the end guide for a railcar truck mounted brake rigging. The means includes at least one elongated groove provided in the at least one surface of the end guide in open communication therewith. The elongated groove has a length thereof disposed generally transverse to a direction of the sliding reciprocal movement of the end guide. A lubricating member is secured within the at least one elongated groove. The lubricating member has a thickness portion thereof protruding, a predetermined height at initial installation, above the at least one surface of the end guide. The predetermined height is reduced during the reciprocal movement of the end guide within the channel or pocket. Material removed from the predetermined height during the reciprocal movement substantially resurfaces the at least one surface of the end guide.

The invention also provides a novel end guide and a brake rigging employing the above-described lubricating means.

The invention further provides a method of lubricating at least one surface of an end guide in a railcar truck mounted brake rigging. The method includes the step of providing an elongated groove within the at least one surface of the end guide in a direction substantially transverse to a direction of a reciprocal sliding movement of the end guide. Next, securing a lubricating member within the elongated groove. Then, extending an upper thickness portion of the lubricating member above the at least one surface of the end guide. And finally, resurfacing the at least one surface of the end guide with the upper thickness portion of the lubricating member during the reciprocal sliding movement of the end guide.

OBJECTS OF THE INVENTION

It is, therefore, one of the primary objects of the present invention to provide a lubricating insert for an end guide of a railcar truck mounted brake rigging.

Another object of the present invention is to provide a lubricating insert for an end guide of a railcar truck mounted brake rigging that can be economically manufactured and installed.

Yet another object of the present invention is to provide a lubricating insert for an end guide of a railcar truck mounted brake rigging that resurfaces the surface of the end guide during operation.

A further object of the present invention is to provide a lubricating insert for an end guide of a railcar truck mounted brake rigging that can be employed with presently used truck frame pocket liners.

Yet a further object of the present invention is to provide a lubricating insert for an end guide of a railcar truck mounted brake rigging that is manufactured from a modified ultra high molecular weight polyethylene material.

An additional object of the present invention is to provide a method of lubricating surfaces of an end guide in a railcar truck mounted brake rigging utilizing the aforementioned lubricating member.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
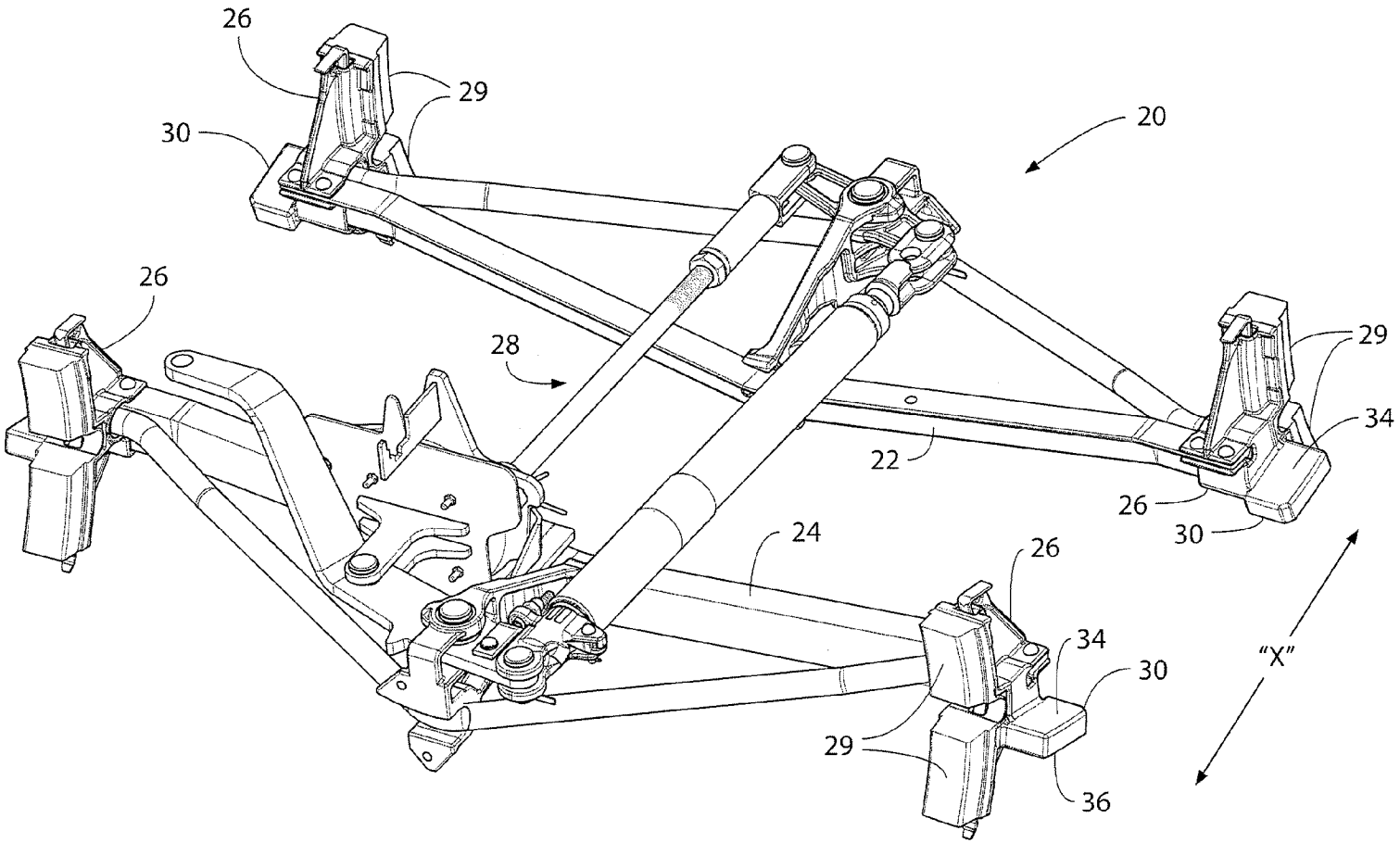
FIG. 1 (PRIOR ART)
FIG. 1 is a perspective view of a prior art truck mounted brake rigging.

Prior to proceeding to the more detailed description of the present invention, it should be noted that, for the sake of clarity and understanding, identical components which have identical functions have been identified with identical reference numerals throughout the several views illustrated in the drawing figures.

It is to be understood that the definition of an end guide applies but is not limited to end foot, end lug or guide lug, brake head paddle, and the like member employed to support truck mounted brake rigging within channels or pockets of the railcar truck side frame.

The best mode for carrying out the invention is presented in terms of its presently preferred embodiment, herein depicted within FIGS. 1 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

Now in reference to FIGS. 1-4, therein is illustrated a partial railcar truck, generally designated as 10, being represented by one side frame 12. The side frame 12 contains a pair of channels or pockets 16 spaced apart along the inner surface 14 of the frame 12. Further, in a conventional manner, each channel or pocket 16 may have a wear liner 18 disposed therewithin between the inner surfaces 17 of the channel or pocket 16, the wear liner 18 having a pair of inner surfaces 19. Such wear liner 18 may be of the type as taught in U.S. Pat. No. 5,862,964, whose teachings are incorporated hereby by reference thereto. For the sake of brevity, the detail description of such wear liner 18 is omitted herewithin.

Figure 2:
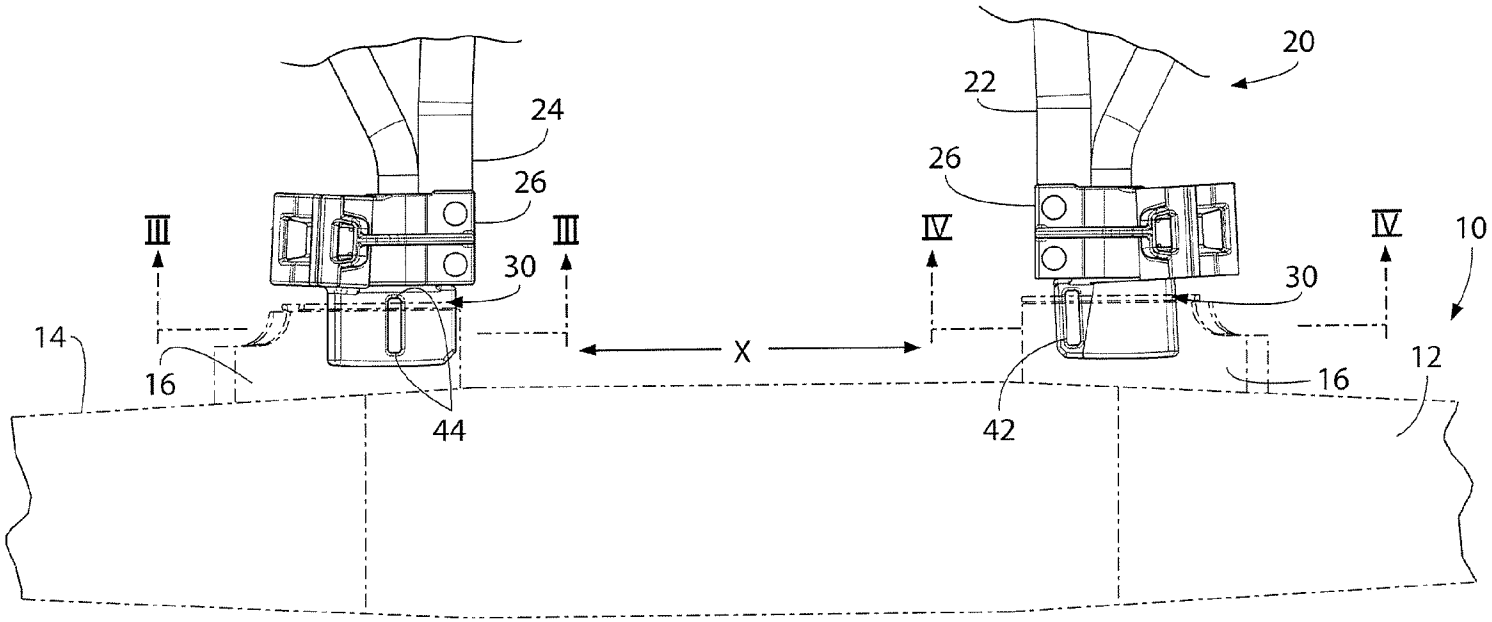
FIG. 2 is a partial planar view of a truck mounted brake rigging employing a lubricating insert of the instant invention.
Figure 4:
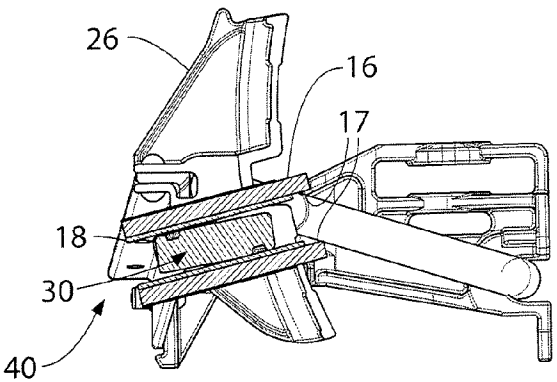
FIG. 4 is another end elevation view of the lubricating insert of FIG. 2.
Figure 3:
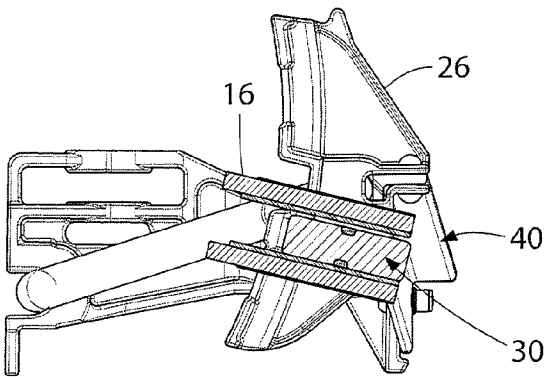
FIG. 3 is one end elevation view of the lubricating insert of FIG. 2.
Figure 5:
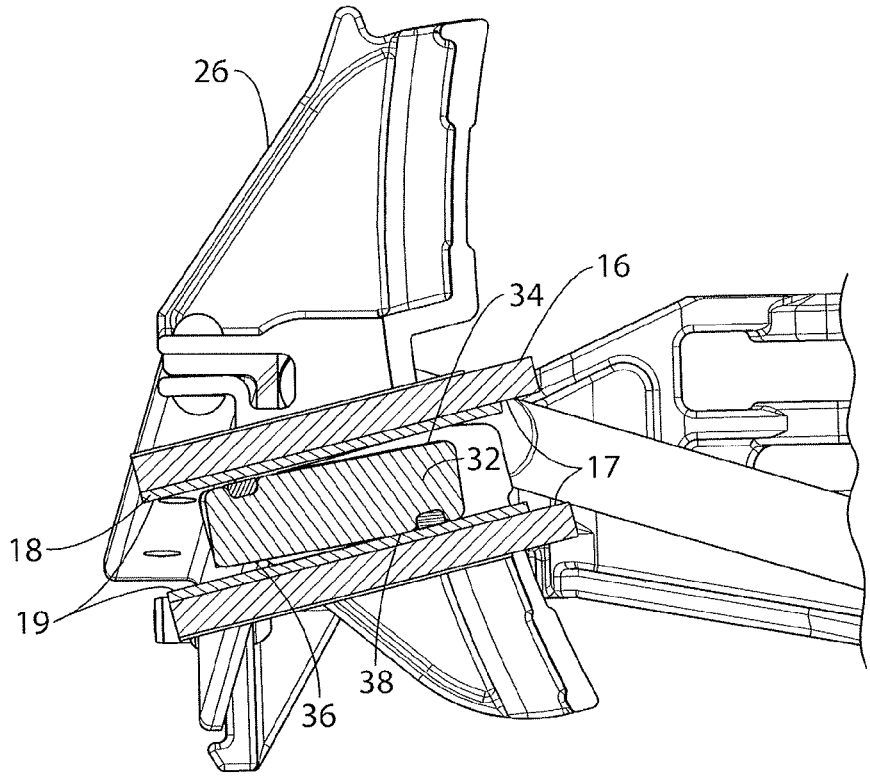
FIG. 5 is a partial enlarged end view of the lubricating insert of FIG. 4.
Figure 6:
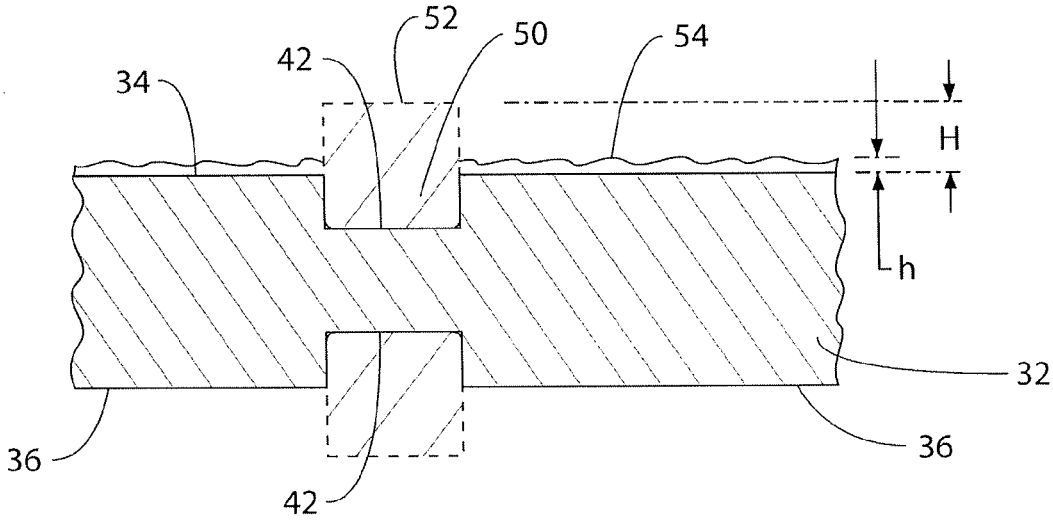
FIG. 6 is a partial enlarged end view of the lubricating insert of FIG. 2, particularly illustrating transformation of an upper portion of the lubricating insert during use.

One type of a conventional brake rigging, generally designated as 20, is best shown in FIG. 1 for reader's convenience and is described briefly herebelow. Such brake rigging 20 includes pair of brake beams 22 and 24 and four brake heads 26, each mounted at an end of the brake beam 24, 26 in alignment with one wheel (not shown) of the railcar truck 10. A linkage arrangement 28 connects the brake beams 22 and 24, so as to reciprocally move the brake beams 22 and 24 to and from each other and enact engagement between the brake shoes 29 and the wheel threads (not shown) during brake application. Conventionally, the brake rigging 20 also includes four end guides 30. The end guide 30 is received for a sliding reciprocal movement, indicated by "X" in FIGS. 1-2, within the channel or pocket 16 during operation of the railcar brake rigging 20. In a conventional manner, the end guide 30 is secured to or formed integral with either brake head 26, as shown in FIGS. 1-2, or an end of each brake beam 22, 24. Each end guide 30 defines a rigid body 32 having a pair of spaced apart substantially flat surfaces 34, 36 defining a thickness of the end guide 30. In operation, each of the pair of opposed substantially flat surfaces 34, 36 engages an inner surface 17 of a channel or pocket 16 or an inner surface 19 of the wear liner 18, as best shown in FIGS. 3-5.

The instant invention provides means, generally designated as 40, for lubricating at least one and, preferably, the pair of opposed substantially flat surfaces 34, 36. Now in a particular reference to FIGS. 5-6, such means 40 includes at least one elongated groove 42 provided in the at least one surface 34, 36 of the rigid body 32 of the end guide 30 in open communication therewith. The elongated groove 42 has a length thereof disposed generally transverse to a direction of the sliding reciprocal movement of the end guide 30. Furthermore, the elongated groove 42 has each end 44 thereof disposed in close proximity to and spaced from a respective longitudinal edge of the end guide 30, as best shown in FIG. 2.

A lubricating member 50 is secured within the at least one elongated groove 40. In further reference to FIG. 6, the lubricating member 50 has a thickness portion 52 thereof protruding, a predetermined height "H" at initial installation, above the at least one surface 34, 36 of the rigid body 32 of the end guide 30. In operation, the predetermined height "H" is reduced during the reciprocal movement of the end guide 30 within the channel or pocket 16. Furthermore, material removed from the predetermined height "H" during the reciprocal movement substantially resurfaces the at least one surface 34, 36 of the end guide 30, by being deposited thereonto as a layer 54 generally having height "h" of FIG. 6. Thus, the height of the lubricating member 50 undergoes transformation from the original installed position to an operating position, wherein the material of the lubricating member 50 is disposed on the one surface 34, 36 of the end guide 30 during reciprocal movement thereof.

The height "H" is determined based on the clearance between the surfaces 34, 36 of the rigid body 32 and the opening of the wear liner 18 or the channel or pocket 16, as mandated by American Association of Railroads (AAR).

It is presently preferred to provided one elongated groove 40 within each surface 32, 34 of the end guide 30, and accordingly provide a pair of lubricating member 50 within each end guide 30.

The instant invention contemplates that the combination of the elongated groove 40 and the lubricating member 50 may be disposed substantially centrally, as shown in FIG. 3 or disposed in close proximity to diagonally opposed ends of the rigid body 32, as best shown in FIG. 4, particularly, when each surface 32, 34 of the rigid body 32 includes a taper 38.

The length of the elongated groove 40 is predetermined so as to substantially resurface the at least one surface 34, 36 of the end guide 30, while assuring secure attachment of the lubricating member therwithin.

Furthermore, providing and elongated groove 40 and orienting the elongated grove 40 in the above-described manner allows use of a single lubricating member 50, thus providing for a simple and economical approach to lubricate at least one surface 34, 36 of the end guide 30. Although, the instant invention contemplates that more than one groove 30 and lubricating insert 50 may be provided within the at least one surface 34, 36.

The presently preferred lubricating member 50 is manufactured from a modified ultra high molecular weight polyethylene material manufactured by ZefTek, a Wabtec company, of Park Ridge, Ill. under the ZEFTUF® brand. Such material is characterized by at least one of each of a molecular weight between about 3.5 and about 6.0 million, tensile yield strength of about 3,050 pounds per square inch, and an abrasion resistance of about 1.4 as determined by internal weight percentage method.

The lubricating member 50 may be secured within the elongated groove 40 by a press fit or any other suitable method.

In operation, as the brake rigging 20 is applied and released, the brake heads 26 of the brake rigging slide up and down the channels or side frame pockets 16. The lubricating members 50 reduce friction during the sliding motion, easing the application and release of the brake rigging 20 while extending operating life of the channels or pockets 16 or wear liners 18.

A method of lubricating at least one surface of an end guide 30 includes the step of providing an elongated groove 40 within the at least one surface of the end guide 30 in a direction substantially transverse to a direction of a reciprocal sliding movement of the end guide. Then, securing a lubricating member 50 within the elongated groove 40. Next, extending an upper thickness portion 52 of the lubricating member 50 above the at least one surface of the end guide 30. Finally, resurfacing the at least one surface of the end guide 30 with the upper thickness portion 52 of the lubricating member 50 during the reciprocal sliding movement of the end guide 30.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. In combination with a railcar brake head having an end guide of a railcar brake rigging which is received within a channel or pocket of a railcar truck side frame and is positioned in said channel or pocket for sliding reciprocal movement within said channel or pocket, means for lubricating a surface of said end guide, said means comprising:

(a) at least one elongated groove provided in said surface of said end guide in open communication therewith, said elongated groove having a length thereof disposed generally transverse to a direction of said sliding reciprocal movement of said end guide;

(b) a lubricating member secured within said at least one elongated groove, said lubricating member having a thickness portion thereof protruding a predetermined height at initial installation above said surface of said end guide;

(c) whereby said predetermined height is configured to be reduced during said reciprocal movement of said end guide within said channel or pocket; and (d) whereby said thickness portion is configured to be removed from said lubricating member during said reciprocal movement and is configured to substantially resurface said surface of said end guide.

2. The combination, according to claim 1, wherein said lubricating member is manufactured from an ultra high molecular weight polyethylene material.

3. The combination, according to claim 2, wherein said ultra high molecular weight polyethylene material has a molecular weight between about 3.5 and about 6.0 million.

4. The combination, according to claim 2, wherein said ultra high molecular weight polyethylene material has tensile yield strength of about 3,050 pounds per square inch.

5. The combination, according to claim 1, wherein said at least one elongated groove has each end thereof disposed in close proximity to and spaced from a respective longitudinal edge of said end guide.

6. An end guide for a railcar truck mounted brake rigging, said end guide comprising:

(a) a rigid body having a pair of opposed substantially flat surfaces defining thickness of said end guide, each of said pair of opposed substantially flat surfaces engaging an inner surface of a channel or pocket of a railcar truck side frame and disposed for a sliding reciprocal movement within said channel or pocket during operation of the railcar brake rigging;

(b) a pair of elongated grooves, each of said pair of elongated grooves provided in said each of said pair of opposed substantially flat surfaces of said rigid body in open communication therewith, said each elongated groove having a length thereof disposed generally transverse to said sliding reciprocal movement of said rigid body;

(c) a pair of lubricating members, each of said pair of lubricating members secured within a respective one of said pair of elongated grooves, and each of said pair of lubricating members having a thickness portion thereof protruding a predetermined height at initial installation above a respective one of said pair of substantially flat surfaces of said rigid body;

(d) whereby for each lubricating member, said predetermined height of said lubricating member is configured to be reduced during said reciprocal movement of said rigid body within said channel or pocket; and (e) whereby for each lubricating member, said thickness portion of said lubricating member is configured to be removed from said lubricating member during said reciprocal movement and is configured to substantially resurface said respective one of said pair of substantially flat surfaces.

7. The end guide, according to claim 6, wherein each elongated groove is disposed substantially centrally on said each of said pair of opposed substantially flat surfaces.

8. The end guide, according to claim 6, wherein each elongated groove is disposed in close proximity to diagonally opposed end of said rigid body.

9. The end guide, according to claim 1, wherein each of said pair of surfaces includes a tapered portion and wherein said each elongated groove is disposed in said tapered portion.

10. The end guide, according to claim 6, wherein said each lubricating member is manufactured from an ultra high molecular weight polyethylene material.

11. The end guide, according to claim 10, wherein said ultra high molecular weight polyethylene material has a molecular weight between about 3.5 and about 6.0 million.

12. The end guide, according to claim 10, wherein said ultra high molecular weight polyethylene material has abrasion resistance of about 1.4 as determined by internal weight percentage method.

13. The end guide, according to claim 6, wherein said end guide is secured to or formed integral with a brake head assembly.

14. The end guide, according to claim 6, wherein said end guide is secured to or formed integral with one end of a brake beam.

15. In combination with a railcar truck having a pair of side frames and a pair of channels or pockets disposed in spaced apart relationship on an inner surface of each side frame, a brake rigging comprising:

(a) a pair of spaced apart brake beams;

(b) a linkage connecting said pair of brake beams and configured to reciprocally move said pair of brake beams respectively in said pair of channels or pockets;

(c) a plurality of brake head assemblies, each of said plurality of brake head assemblies disposed at an end of a brake beam in alignment with one wheel of said railcar truck;

(d) a plurality of rigid bodies, each of said plurality of rigid bodies having a pair of opposed substantially flat surfaces, each of said pair of opposed substantially flat surfaces engaging an inner surface of a respectively positioned channel or pocket of said railcar truck and disposed for a sliding reciprocal movement in the channel or pocket during operation of said brake rigging;

(e) a plurality of elongated grooves, each of said plurality of elongated grooves provided in said each of said pair of opposed substantially flat surfaces of said each rigid body in open communication therewith, said each elongated groove having a length thereof disposed generally transverse to said sliding reciprocal movement of said each rigid body;

(f) a plurality of lubricating members, each of said plurality of lubricating members secured within a respective one of said plurality of elongated grooves and each of said lubricating members having a thickness portion thereof protruding a predetermined height at initial installation above a respective one of said pair of substantially flat surfaces of said each rigid body;

(g) whereby for each lubricating member, said predetermined height of said lubricating member is configured to be reduced during said reciprocal movement of said each rigid body within said channel or pocket; and (h) whereby for each lubricating member, said thickness portion of said lubricating member is configured to be removed from said lubricating member during said reciprocal movement and is configured to substantially resurface said respective one of said pair of substantially flat surfaces of said each rigid body.

16. The combination of claim 15, wherein said each rigid body is secured to or formed integral with said brake head assembly.

17. The combination of claim 15, wherein said each rigid body is secured to or formed integral with said one end of said brake beam.

18. The combination of claim 15, wherein said each lubricating member is secured within a respective elongated groove by a press fit method.

19. A method of lubricating a surface of an end guide in a railcar truck mounted brake rigging, said method comprising the steps of:

(a) providing an elongated groove within said surface of said end guide in a direction substantially transverse to a direction of a reciprocal sliding movement of said end guide;

(b) securing a lubricating member within said elongated groove;

(c) extending an upper thickness portion of said lubricating member above said surface of said end guide; and (d) resurfacing said surface of said end guide with said upper thickness portion of said lubricating member during said reciprocal sliding movement of said end guide by causing said upper thickness portion of said lubricating member to engage an opposing surface of a side frame guide bracket of said brake rigging, to separate from the lubrication member, and to engage said surface of said end guide.

* * * * *